US009761385B2

(12) United States Patent
Balgheim et al.

(10) Patent No.: US 9,761,385 B2
(45) Date of Patent: Sep. 12, 2017

(54) ELECTRIC SWITCH

(71) Applicant: Johnson Electric S.A., Murten (CH)

(72) Inventors: Udo Balgheim, Hueckeswagen (DE); Gerhard Fangmann, Marienheide (DE)

(73) Assignee: JOHNSON ELECTRIC S.A., Murten (CH)

( * ) Notice: Subject to any disclaimer, the term of this patent is extended or adjusted under 35 U.S.C. 154(b) by 93 days.

(21) Appl. No.: 14/849,014

(22) Filed: Sep. 9, 2015

(65) Prior Publication Data

US 2016/0071661 A1 Mar. 10, 2016

(30) Foreign Application Priority Data

Sep. 9, 2014 (DE) ..... 10 2014 112 982

(51) Int. Cl.

| | |
|---|---|
| ***H01H 9/28*** | (2006.01) |
| ***H01H 9/20*** | (2006.01) |
| ***H01H 21/22*** | (2006.01) |
| ***H01H 9/06*** | (2006.01) |
| ***H01H 19/38*** | (2006.01) |
| *H01H 19/11* | (2006.01) |
| *H01H 9/04* | (2006.01) |

(52) U.S. Cl.

CPC ..... *H01H 9/20* (2013.01); *H01H 9/061* (2013.01); *H01H 9/063* (2013.01); *H01H 19/38* (2013.01); *H01H 21/22* (2013.01); *H01H 19/11* (2013.01); *H01H 2009/048* (2013.01); *H01H 2207/034* (2013.01); *H01H 2221/016* (2013.01); *H01H 2231/048* (2013.01)

(58) Field of Classification Search

CPC ..... H01H 9/20; H01H 21/22; H01H 19/38; H01H 9/061; H01H 9/063

USPC ..... 200/522, 293.1, 332.2

See application file for complete search history.

(56) References Cited

U.S. PATENT DOCUMENTS

| | | | | |
|---|---|---|---|---|
| 4,100,383 | A | 7/1978 | Piber | |
| 5,892,885 | A * | 4/1999 | Smith | H01H 9/061 318/139 |
| 8,410,387 | B2 * | 4/2013 | Niklewski | H01H 9/061 200/522 |
| 2006/0186102 | A1 | 8/2006 | Inagaki et al. | |
| 2006/2437751 | | 11/2006 | Omori et al. | |
| 2014/0166449 | A1 | 6/2014 | Ho et al. | |
| 2014/0225331 | A1 | 8/2014 | Hozumi et al. | |

FOREIGN PATENT DOCUMENTS

| | | |
|---|---|---|
| DE | 8307428 | 7/1983 |
| DE | 102008003246 | 7/2008 |
| EP | 0048124 | 3/1982 |
| EP | 1873800 | 1/2008 |
| EP | 2688080 | 1/2014 |

* cited by examiner

*Primary Examiner* — Edwin A. Leon
*Assistant Examiner* — Lheiren Mae A Caroc
(74) *Attorney, Agent, or Firm* — Muncy, Geissler, Olds & Lowe, P.C.

(57) ABSTRACT

An electric switch, in particular for manually operated electric tools or appliances with an electric motor, is switchable from outside by means of a plunger. A changeover device is provided for setting the direction of rotation of the electric motor, which changeover device can be activated for example by a tappet arranged on the outside. The switch is constructed very compactly, which simplifies the sealing of a switch of this type.

16 Claims, 5 Drawing Sheets

ELECTRIC SWITCH

CROSS REFERENCE TO RELATED APPLICATIONS

This non-provisional patent application claims priority under 35 U.S.C. §119(a) from Patent Application No. DE102014112982.2 filed in Germany on Sep. 9, 2014, the entire contents of which are hereby incorporated by reference.

FIELD OF THE INVENTION

This invention relates to an electric switch and in particular, to a switch for manually operated electric hand tools and appliances.

BACKGROUND OF THE INVENTION

In general, electric switches of this type for manually operated electric tools and appliances, such as electric drills, cordless screwdrivers, hammer drills, food blenders, or the like, include, in addition to the electric circuit which can be switched by an activation element that is activated from outside, control and regulation of the rotational speed or torque of the motor. In general, rotary or slide potentiometers are used for this purpose. In addition to this rotational speed control, it is also desired to set the direction of rotation, for example via a mechanical changeover device. This requires a high number of contact systems which leads to a complex structure of the switch. A compact electric switch is known from DE 10 1009 009 965 A1. In this case, the electrical components are arranged on both sides of the circuit board, which is known from the prior art. However, it is disadvantageous that the entire circuit board must be pivoted in the housing in order to switch over the direction of rotation. This places additional challenges on the sealing system in particular.

SUMMARY OF THE INVENTION

Hence there is a desire for a compact electric switch which at least mitigates the above disadvantages.

Accordingly, in one aspect thereof, the present invention provides an electric switch for a manually operated electric device with an electric motor, comprising: a switch housing; a contact system having at least one contact arranged in the switch housing; a plunger which protrudes out of the switch housing, is connected to an activation element, and by means of its movement can switch at least one of the contacts of the contact system from an off position into an on position; and a circuit board fixed in the switch housing and has contact surfaces in the form of potentiometer circuits on one of its sides; wherein the plunger within the switch housing comprises a slider which has sliding contacts on the side of the slider facing the circuit board, wherein the rotational speed or the torque of the electric motor is adjustable through interaction of the sliding contacts with the contact surfaces of the circuit board, and wherein the contact surfaces and the at least one contact of the contact system are arranged on the upper face of circuit board, wherein the slider is moveable along the orientation of the contact surfaces in a plane parallel to the circuit board and the working direction of the contacts of the contact system likewise lies in a plane parallel to the circuit board.

Preferably, the slider can be moved linearly along the contact surfaces oriented in straight lines or can be moved by means of a rotational movement along contact surfaces oriented as circular shapes, the plunger is movable linearly with the slider and a projection provided on the plunger prevents a switching of the contact system in the off position.

Preferably, the switch includes a changeover device for changing the direction of rotation of the electric motor, and conducting paths are provided on a lower face of the circuit board and interact with the changeover device for running the electric motor in a selectable direction of rotation.

Preferably, the changeover device includes a position encoder which can be adjusted to switch over between a clockwise and a counter-clockwise rotation by means of a displacement movement or by means of a rotational movement.

Alternatively, the changeover device comprises a position encoder, which can be operated from outside, and a switch lever arranged moveably inside the switch housing parallel to the circuit board, wherein the switch lever is connected on the one side to the position encoder and is mounted on the other side by means of a support arm on the circuit board, wherein the support arm forms the pivot axis of the switch lever.

Preferably, two contact tongues are provided on a side of the switch lever facing the circuit board, the two contact tongues, according to the pivot position of the switch lever, selectively contact the conducting paths provided on the lower face of the circuit board for clockwise rotation of the electric motor or contact the conducting paths for the counter-clockwise rotation of the electric motor.

Preferably, the switch lever is a two-armed lever having a short arm and a long arm, and the switch lever is connected on the free end of the short lever arm to the support arm and on the free end of the long lever arm to the position encoder.

Preferably, the switch housing comprises a top shell and a bottom shell which in the assembled state delimit a common opening on a side wall of the switch housing for the plunger.

Preferably, the two shells are connected to one another via a clamping connection.

Preferably, a one-piece circumferential seal is provided between the two shells of the switch housing, which seal is formed into a ring in the area of the opening of the switch housing.

Preferably, the bottom shell has a recess for the position encoder of the changeover device and a cable connection, which are both provided with seals.

Preferably, a sealing ring is inserted into an annular groove of the recess and a multilayer sealing packet is inserted into the cable connection.

Preferably, the position encoder is configured as a disk and the disk is rotatably mounted in a recess of the switch housing, a tappet for rotational activation is provided on an outside of the disk, and the disk is connected on an inner side to the switch lever in a torque transmitting way.

Preferably, a haptic element is provided between the inner side of the disk and the switch lever, which haptic element interacts with a peripheral contour of the recess of the switch housing.

Preferably, a return spring mounted in the switch housing engages with the plunger and the spring force of said return spring works in the direction of the off position.

Preferably, the at least one contact of the contact system comprises a fixed contact and a switch contact, wherein the fixed contact is a pin fixed on the circuit board and the switch contact comprises a pin fixed on the circuit board however with an associated torsion spring, wherein in the on position, due to the spring force of the torsion spring, said spring laterally contacts the fixed contact with a spring arm, and wherein in the off position, the projection on the plunger holds the arm of the torsion spring at a distance from the fixed contact and prevents contacting.

INDUSTRIAL APPLICATION

Operation of preferred embodiments will now be described as an aid to understanding the invention. The electric switch is to be used for electric devices, in particular for manually operated electric tools and appliances with an electric motor. Switches of this type are commonly referred to a trigger switches and have a switch housing. Protruding from this switch housing is a plunger, which is connected to an activation element for manual operation of the electric device. Activation of the activation element causes a movement of the plunger, namely from a starting position, in which the electric device is switched off, into an on position, in which the electric device is switched on, as this plunger movement switches at least one contact of a contact system arranged in the switch housing. A circuit board is arranged fixed in the switch housing and has, in addition to the two contacts of the previously mentioned contact system, further contact surfaces in the form of potentiometer circuits. According to this invention, the contact surfaces and the two contacts of the contact system are arranged on one side of the circuit board, for example the upper face. The contact surfaces formed as potentiometer circuits interact with sliding contacts which are provided on the underside of a slider connected to the plunger, such that this slider with its sliding contacts is displaced by the movement of the plunger. By moving the slider, the rotational speed or the torque of the electric motor connected to the switch may be adjusted. The movement of the plunger and the slider linked thereto may be a linear movement in a plane parallel to the circuit board and along contact surfaces oriented in straight lines. A rotational movement is, however, also possible if the contact surfaces are arranged in circular shapes on the circuit board. By moving the plunger, the contact system is also opened or closed; in this case the working direction of the contacts likewise run in a plane parallel to the circuit board, like the plunger movement.

In addition, the electric switch preferably includes a changeover device for changing the direction of rotation of the electric motor, i.e. from clockwise to counter-clockwise. Corresponding conducting paths are provided on the circuit board for this purpose. The changeover device interacts in this case with the other side of the circuit board, for example the lower face, on which the corresponding conducting paths are provided.

In an embodiment of the invention, by activating the plunger, it is moved from its off position into an on position and by this means a contact is established between the switch contact and the fixed contact of the contact system arranged in the switch housing. In the off position of the plunger, a projection provided on the plunger prevents a connection of the contact system. In an embodiment of this type, the contact system consists of a pin fixed on the circuit board as a fixed contact and a pin, likewise fixed on the circuit board, however, in this case with an associated torsion spring, as the switch contact. In the off position, the projection on the plunger prevents a free arm of the torsion spring of the switch contact from contacting the fixed contact. The projection of the plunger holds the arm of the torsion spring of the switch contact at a distance from the fixed contact. In contrast, in the on position, due to the preferably linear movement of the plunger, its projection is also moved away from the switch contact and the arm of the torsion spring is released and may, due to the spring force of the torsion spring, move in the direction of the fixed contact and contact the same, preferably laterally. The arm of the torsion spring moves in this case in a plane parallel to the circuit board.

In addition, a movement of the plunger also adjusts the rotational speed or the torque of the electric motor, since the sliding contacts provided on the slider of the plunger interact with the contact surfaces of the circuit board configured as potentiometer circuits, and, because the resistance changes due to the change of the adjustment travel of the sliding contact on the contact surfaces, for example, the rotational speed of the electric motor can be regulated by this means. Thus, the plunger on the one hand causes the contacting for switching on the electric motor and simultaneously the adjustment of the rotational speed. This is possible due to the special configuration of the plunger with a projection and slider, with the arrangement of the contacts of the contact system, and the contact surfaces provided on one side, for example the upper face, of the circuit board in the form of potentiometer circuits.

The other side of the circuit board contacts the changeover device. This changeover device also has an actuator accessible from outside for setting the clockwise or counter-clockwise rotation of the electric motor. This setting can be carried out by a linear sliding movement of the actuator or by a rotational movement. The actuator is preferably a position encoder which is operable from outside and adjustable by a rotational movement, and which is connected to a shift lever arranged within the switch housing. The position encoder is mounted in a recess of the housing. In a preferred embodiment, the outer part of the position encoder is configured as a disk and this disk is rotatably mounted in a round recess of the switch housing, wherein a tappet for rotary actuation is provided on the outside of the disk, which tappet interacts for example with a rotational direction switch of the manually operated electric device. During a rotational actuation of the disk of the position encoder, the torque is transmitted to the shift lever provided in the inside of the switch housing, which switch lever is connected on the one side to the position encoder and on the other side to a support arm fixed to the circuit board and mounted via this support arm on the circuit board. This support arm thereby forms the pivot axis of the shift lever. The shift lever is oriented parallel to the circuit board and may be moved in this plane by a pivot movement into at least two positions. According to the pivot position of the shift lever, contact tongues, which are arranged on the shift lever, contact either circuit paths of the circuit board for the clockwise rotation of the electric motor or alternatively, the contact tongues establish a contact bridge for circuit paths for the counter-clockwise rotation of the electric motor.

In a particularly preferred embodiment, the position encoder also comprises a haptic element. This haptic element interacts with a perimeter contour of the recess of the switch housing, which contour has catch positions corresponding to the different positions of the shift lever.

The previously described electric switch is designed very compactly, since both sides of the circuit board are available for the different functions of the switch and the circuit board is arranged fixed in the housing. This simplifies the sealing of an electric switch of this type. In an embodiment of the invention, the switch housing is constructed from two shells for easier assembly, namely an upper shell and an under shell. These shells are preferably connected to one another via a clamping connection. In the assembled state, both shells delimit a common opening for the plunger on the side wall. For sealing the switch housing, a one-piece, circumferential seal is provided between the shells of the switch housing, which seal is shaped as a ring in the region of the opening for the plunger. The additional openings on the switch housing may likewise be sealed in a simple way, thus, for example, an annular groove may be provided in a recess for the disk-shaped position encoder, in which groove a sealing ring is inserted. For the necessary cable connection in the switch housing, i.e. for the electrical cable that leads to the electric motor, a multilayer sealing packet, for example, may be used.

Switches according to the invention are particularly used for use with electric devices employing electrically commutated motors such as brushless direct current (BLDC) motors and brushless alternating current (BLAC) motors.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
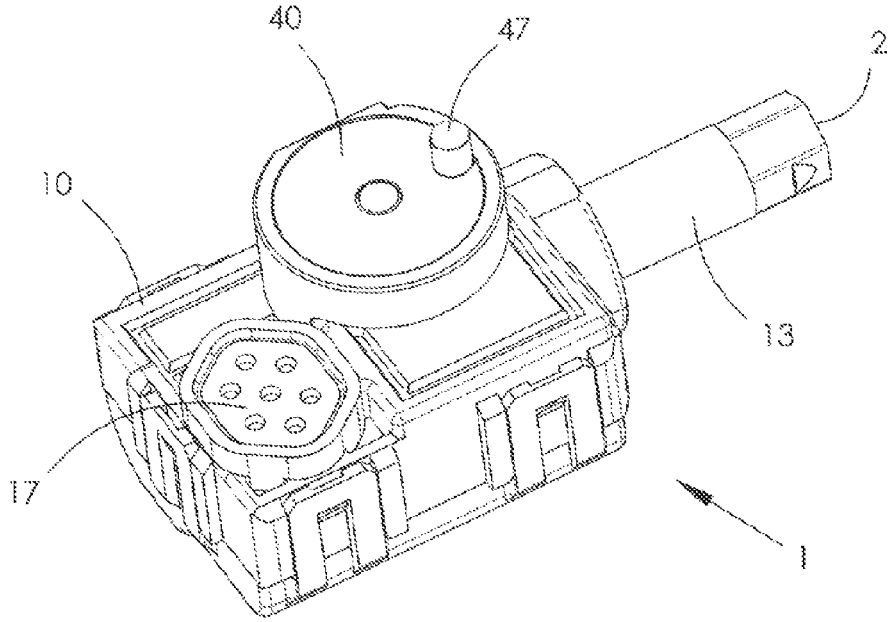
FIG. 1 is a perspective view of an electric switch according to the preferred embodiment of the present invention.

The drawings show a preferred embodiment of an electric switch 1 according to the invention, which may be used for manually operated electric tools and appliances with an electric motor, for example, electric drills, cordless screwdrivers, hammer drills, food blenders and the like. For this purpose, this electric switch 1 is incorporated in the housing of the tool and the plunger 13 is connected to, for example, a manually actuatable activation member via a connection 2. Out of switch 1 at the cable connection 17, a corresponding electrical cable (not shown in the drawings) extends for the connection to the electric motor. The changeover device 40, which is installed in switch housing 10 of electric switch 1, is shiftable from outside via a tappet 47, sets the direction of rotation of the electric motor, and functions together, for example, with a corresponding shift lever in an electric tool. The shift lever being shiftable from outside. For manually operated electric devices, in which no different direction of rotation of the electric motor must be provided, the changeover device 40 may be omitted.

Figure 2:
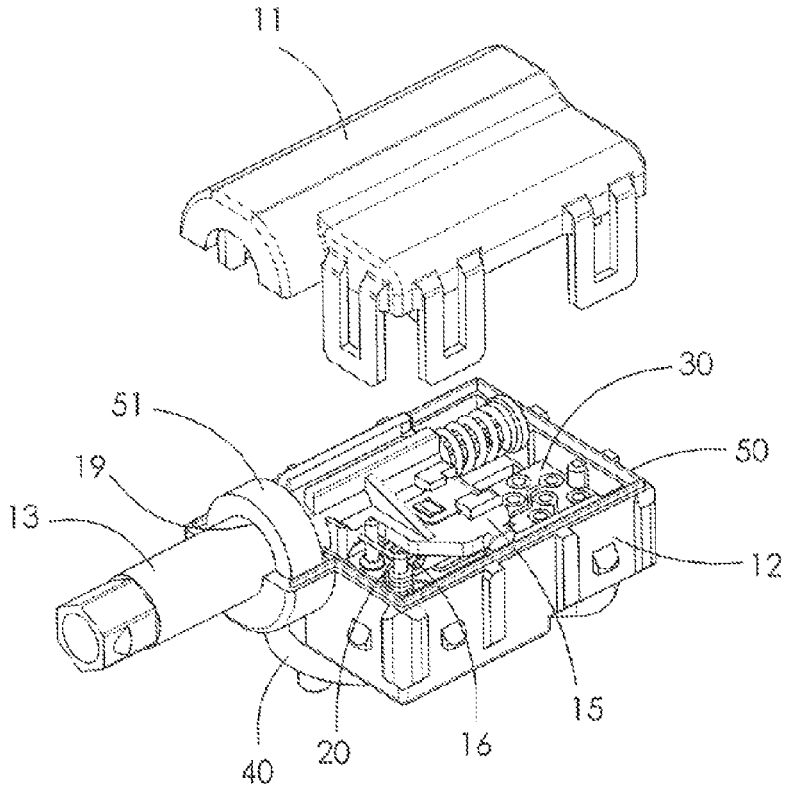
FIG. 2 is a perspective view of the switch of FIG. 1 from a different aspect with an upper shell lifted off.

The switch housing 10 of the electric switch 1 shown in FIG. 1 comprises two shells, namely a first or top shell 11 and a second or bottom shell 12. This is to be gathered from FIG. 2 and FIG. 3, where electric switch 1 is represented from two sides, in each case with an opened switch housing 10. The good seal of switch 1 may be gathered from these figures. Thus, a one-piece, circumferential seal 50 is provided between shells 11 and 12 and arranged on the edges of shells 11 and 12 and comprises a ring 51 in the area of the opening 19. Opening 19 is formed by the two shells 11 and 12. Opening 19 is provided for plunger 13 which protrudes out of housing 10 of switch housing 10 of switch 1, as shown in FIG. 1. Inside of switch housing 10, plunger 13 is connected to a slider 15 which is arranged to be moveable, in this case by a linear displacement movement, above a circuit board 30 arranged fixed in switch housing 10. Plunger 13 may be activated by an activation element, that is displaced into switch housing 10. With this displacement movement of plunger 13, slider 15 connected to plunger 13 is displaced and, during this movement, interacts with its sliding contact 16 on contact surfaces 33, 34 on the upper face 31 of circuit board 30. Sliding contact 16 can be better understood from FIGS. 4 and 5, as circuit board 30 is presented on the one hand in perspective and without housing and on the other as a view of the upper face 31 of circuit board 30. Sliding contact 16 is provided on a side of slider 15 facing the circuit board (not shown in FIGS. 4 and 5). The contact ends 16*a*, 16*b* contact contact surfaces 33, 34 on upper face 31 of circuit board 30. Based on the flexible U-shape of sliding contact 16, a sufficient contact pressure is ensured. During the movement of plunger 13, slider 15 displaces along circuit board 30, i.e. along contact surfaces 33, 34 configured as potentiometer circuits. The resistance, and thus the rotational speed or torque of the electric motor connected to switch 1, changes with the displacement path of sliding contact 16.

Figure 4:
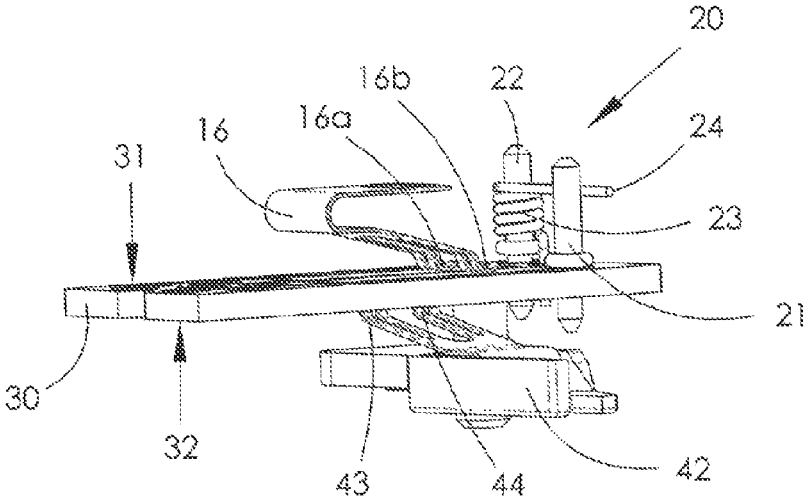
FIG. 4 illustrates a circuit board of the switch.
Figure 5:
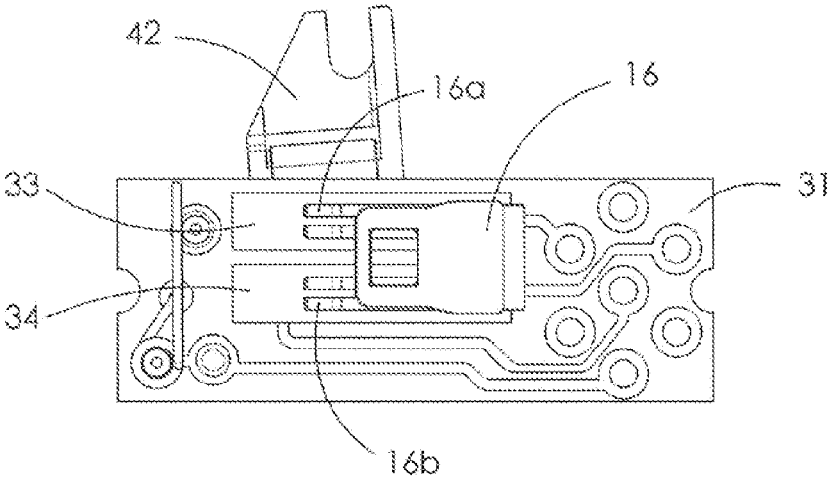
FIG. 5 is a top view of the circuit board of FIG. 4.
Figure 10:
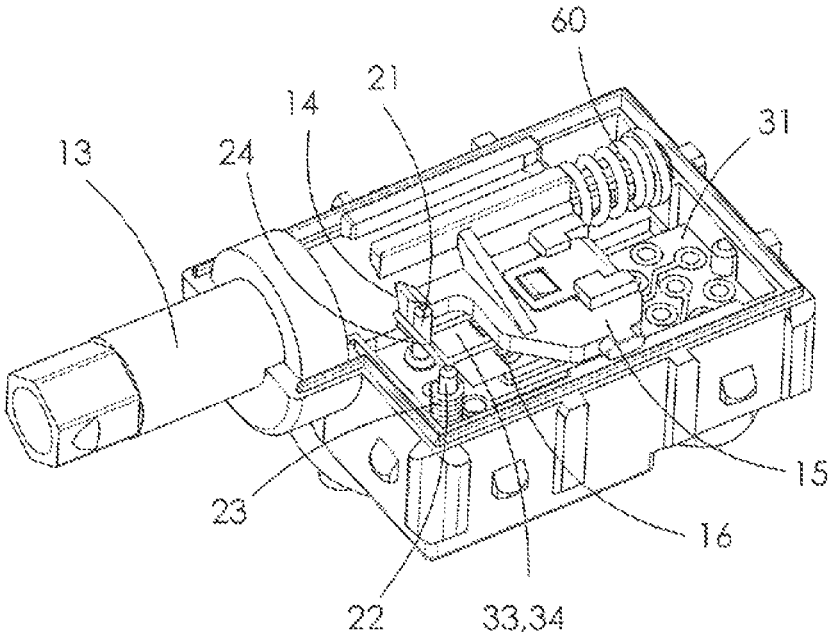
FIG. 10 is a perspective view of part of the switch of FIG. 1 in the on position.
Figure 11:
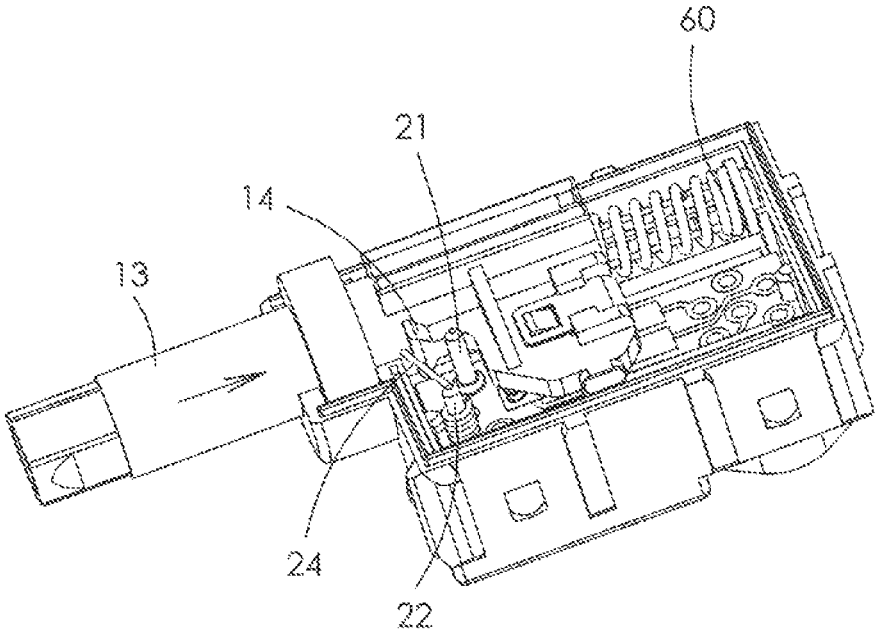
FIG. 11 is a view similar to FIG. 10, with the switch in the off position.

The contact system 20 is also provided adjacent to contact surfaces 33, 34 on upper face 31 of circuit board 30. This comprises, as can be seen in FIG. 4, a fixed contact 21, configured as a pin and fixed to circuit board 30, and a switch contact 22. The switch contact 22 likewise comprises a pin fastened to circuit board 30 and a torsion spring 23. If, for example, the direction of rotation for the electric motor has been set by the position encoder 45 and plunger 13 has been moved via an activation element from its off position, shown in FIG. 11, into its on position, shown in FIG. 10, i.e. displaced into switch housing 10, then a projection 14, provided on plunger 13, is also displaced by this movement. This projection 14 abuts, in the off position as shown in FIG. 11, on the end of the arm 24 of torsion spring 23 of switch contact 22 and holds said arm at a distance from fixed contact 21. If projection 14 is now also moved away from arm 24 by the displacement of plunger 13, said arm may now press laterally on fixed contact 21 due to the spring force of torsion spring 23, by which means a switching on of the electric motor is caused. The movement of arm 24 of torsion spring 23 and thus the working direction for opening and closing contact system 20 is in a plane parallel to and above circuit board 30. Plunger 13 is spring-loaded in this case in this example. A return spring 60 affects an automatic return of plunger 13 into an off position as soon as no pressure is exerted on plunger 13 by means of the activation element (not shown).

Figure 6:
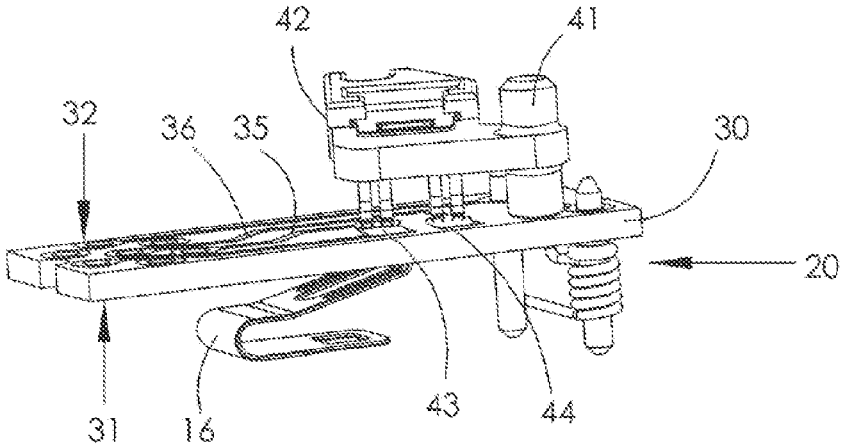
FIG. 6 is a perspective view of the circuit board from a different aspect.
Figure 7:
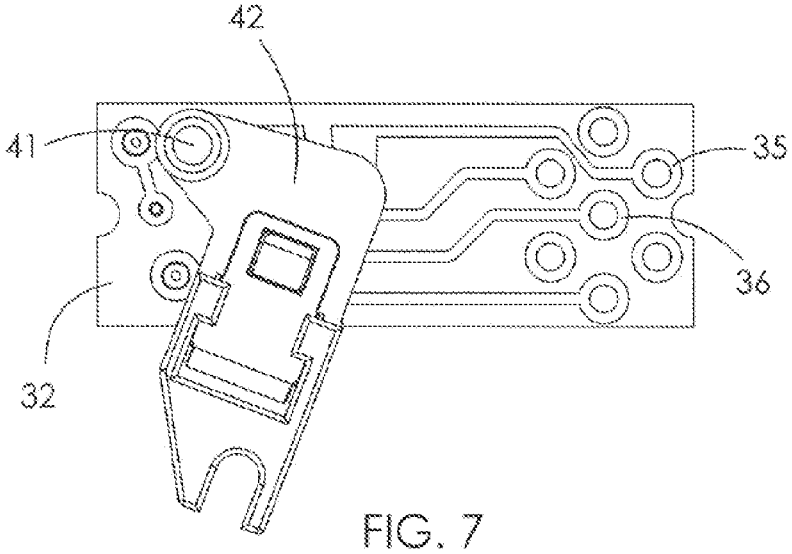
FIG. 7 is a view of the lower face of the circuit board of FIG. 4.
Figure 8:
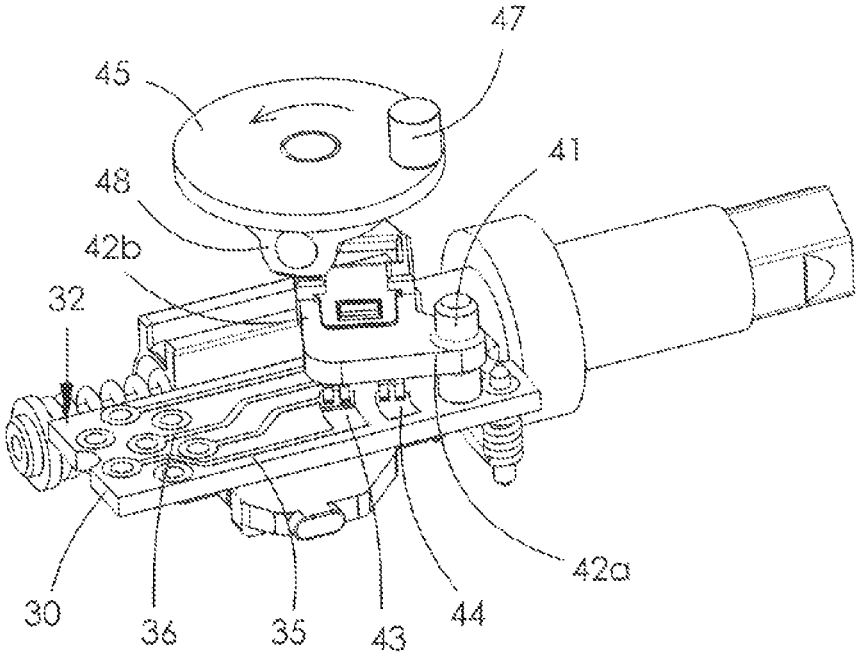
FIG. 8 illustrates a changeover device of the switch in position for counter clockwise rotation of the motor.
Figure 9:
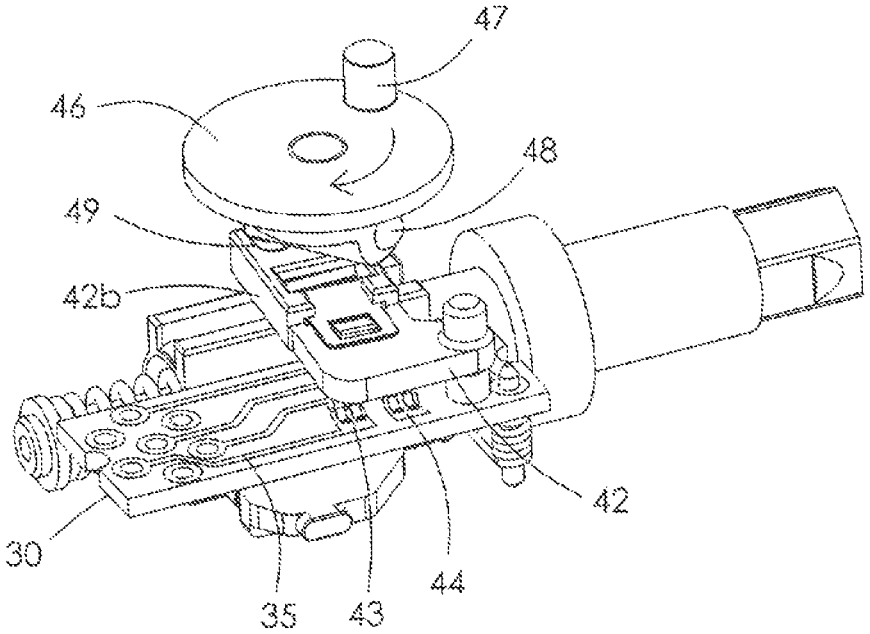
FIG. 9 illustrates the changeover device of the switch in position for clockwise rotation of the motor.

On the opposite side, the lower face 32 of circuit board 30, the conducting paths 35, 36, provided on circuit board 30, are in operative connection with a switch lever 42 of changeover device 40. This switch lever 42 extends in a plane parallel to circuit board 30, as can be seen in FIG. 6. This shift lever 42 may be pivoted in this parallel plane around a pivot axis, formed by support arm 41, underneath circuit board 30. Support arm 41 is connected to circuit board 30 and supports switch lever 42. On the underside of switch lever 42, contact tongues 43, 44 are provided, which represent either a contact bridge for conducting path 35 for counter-clockwise rotation of the electric motor, or alternatively a contact bridge for conducting path 36 for clockwise rotation of the electric motor. To change the direction of rotation, switch lever 42 is pivoted. For this purpose, switch lever 42 is connected to position encoder 45 of changeover device 40, as can be seen better in FIGS. 8 and 9. In this embodiment, switch lever 42 is configured as a two-armed lever. The short lever arm 42*a* is mounted on its free end on support arm 41, and the free end of the long arm 42*b* of switch lever 42 is connected to position encoder 45. In this case, switch lever 42 is connected via the connecting element 49 (see FIG. 9) to a haptic element 48 of position encoder 45. Disk 46 of position encoder 45 is located outside of the switch housing, said disk is mounted together with haptic element 48 in a recess 18 of switch housing 10, as can be gathered from FIG. 3. Tappet 47 is provided on the outer side of disk 46, which tappet either protrudes directly out of the housing of the electric device or preferably is connected to a changeover lever adjustable from outside. To switch over the direction of rotation of the electric motor, i.e. for setting the clockwise or counter-clockwise rotation of the electric motor, this tappet 47 is moved. Disk 46 executes, together with haptic element 48 in recess 18, a rotational movement. By this means, haptic element 48 interacts with a perimeter contour 18*a* of recess 18. Haptic element 48 is in this case connected rotationally fixed with disk 46, for example, a correspondingly-shaped recess, for example a square recess, is present on the lower face of disk 46, in which recess a correspondingly shaped head of haptic element 48 engages. As can be gathered especially from FIG. 9, a spring-mounted ball protrudes on at least one side of haptic element 48 laterally out of the haptic element and engages with peripheral contour 18*a* of recess 18. If, for example, tappet 47 is moved, by which means disk 46 executes a rotational movement and haptic element 48, due to the rotationally fixed connection, is moved as well, the spring-loaded laterally protruding ball is pressed into haptic element 48 until, after a certain rotational path, the ball again finds space in a corresponding recess of peripheral contour 18*a*. Peripheral contour 18*a* of recess 18 is especially configured such that this is only the case in the two switch positions of switch lever 42. Haptic element 48 preferably has on two opposite sides respectively a ball protruding laterally out of haptic element 48, which balls are pressed outward by a common spring. This increases the haptic impression. The two different switch positions of switch lever 42, i.e. the two different positions of position encoder 45, are represented in FIGS. 8 and 9. The potential movement direction of position encoder 45 is indicated by the arrow.

Figure 3:
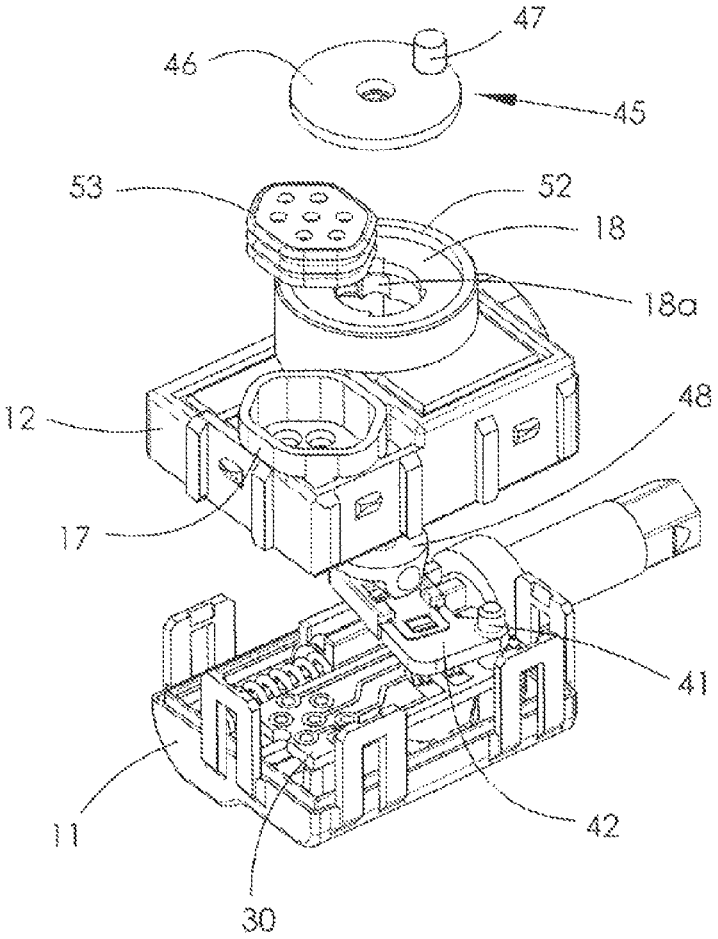
FIG. 3 is a partially exploded view of the switch.

The access to position encoder 45 in switch housing 10 is sealed by a sealing ring 52, which is preferably arranged in an annular groove of recess 18. A cable connection 17 is provided in switch housing 10, namely in bottom shell 12 of switch housing 10, adjacent to position encoder 45, which cable connection leads all cables (not shown) commonly out of switch housing 10. For sealing, the sealing packet 53, shown in FIG. 3, is provided which surrounds the cable with multiple sealing layers.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. An electric switch for a manually operated electric device with an electric motor, comprising:

a switch housing;

a contact system having at least one contact arranged in the switch housing;

a plunger which protrudes out of the switch housing, is connected to an activation element, and by means of its movement can switch at least one of the contacts of the contact system from an off position into an on position; and a circuit board fixed in the switch housing and has contact surfaces in the form of potentiometer circuits on one of its sides;

wherein the plunger within the switch housing comprises a slider which has sliding contacts on the side of the slider facing the circuit board, wherein the rotational speed or the torque of the electric motor is adjustable through interaction of the sliding contacts with the contact surfaces of the circuit board, wherein the contact surfaces and the at least one contact of the contact system are arranged on the upper face of circuit board, wherein the slider is moveable along the orientation of the contact surfaces in a plane parallel to the circuit board and the working direction of the contacts of the contact system likewise lies in a plane parallel to the circuit board, and wherein a projection provided on the plunger prevents a switching of the contact system in the off position.

2. The switch of claim 1, wherein the slider can be moved linearly along the contact surfaces oriented in straight lines or can be moved by means of a rotational movement along contact surfaces oriented as circular shapes, the plunger is movable linearly with the slider.

3. The switch of claim 1, further comprising a changeover device for changing the direction of rotation of the electric motor, wherein conducting paths are provided on a lower face of the circuit board and interact with the changeover device for running the electric motor in a selectable direction of rotation.

4. The switch of claim 3, wherein the changeover device includes a position encoder which can be adjusted to switch over between a clockwise and a counter-clockwise rotation by means of a displacement movement or by means of a rotational movement.

5. The switch of claim 3, wherein the changeover device comprises a position encoder, which can be operated from outside, and a switch lever arranged moveably inside the switch housing parallel to the circuit board, wherein the switch lever is connected on the one side to the position encoder and is mounted on the other side by means of a support arm on the circuit board, wherein the support arm forms the pivot axis of the switch lever.

6. The switch of claim 5, wherein two contact tongues are provided on a side of the switch lever facing the circuit board, the two contact tongues, according to the pivot position of the switch lever, selectively contact the conducting paths provided on the lower face of the circuit board for clockwise rotation of the electric motor or contact the conducting paths for the counter-clockwise rotation of the electric motor.

7. The switch of claim 5, wherein the switch lever is a two-armed lever having a short arm and a long arm, and the switch lever is connected on the free end of the short lever arm to the support arm and on the free end of the long lever arm to the position encoder.

8. The switch of claim 5, wherein the switch housing comprises a top shell and a bottom shell which in the assembled state delimit a common opening on a side wall of the switch housing for the plunger.

9. The switch of claim 8, wherein the two shells are connected to one another via a clamping connection.

10. The switch of claim 8, wherein a one-piece circumferential seal is provided between the two shells of the switch housing, which seal is formed into a ring in the area of the opening of the switch housing.

11. The switch of claim 8, wherein the bottom shell has a recess for the position encoder of the changeover device and a cable connection, which are both provided with seals.

12. The switch of claim 11, wherein a sealing ring is inserted into an annular groove of the recess and a multilayer sealing packet is inserted into the cable connection.

13. The switch of claim 8, wherein the position encoder is configured as a disk and the disk is rotatably mounted in a recess of the switch housing, a tappet for rotational activation is provided on an outside of the disk, and the disk is connected on an inner side to the switch lever in a torque transmitting way.

14. The switch of claim 13, wherein a haptic element is provided between the inner side of the disk and the switch lever, which haptic element interacts with a peripheral contour of the recess of the switch housing.

15. The switch of claim 1, wherein a return spring mounted in the switch housing engages with the plunger and the spring force of said return spring works in the direction of the off position.

16. The switch of claim 1, wherein the at least one contact of the contact system comprises a fixed contact and a switch contact, wherein the fixed contact is a pin fixed on the circuit board and the switch contact comprises a pin fixed on the circuit board however with an associated torsion spring, wherein in the on position, due to the spring force of the torsion spring, said spring laterally contacts the fixed contact with a spring arm, and wherein in the off position, the projection on the plunger holds the arm of the torsion spring at a distance from the fixed contact and prevents contacting.

* * * * *